US011606848B2

(12) United States Patent
Mekhtarian

(10) Patent No.: US 11,606,848 B2
(45) Date of Patent: Mar. 14, 2023

(54) LIGHTING SYSTEMS

(71) Applicant: George Mekhtarian, Canoga Park, CA (US)

(72) Inventor: George Mekhtarian, Canoga Park, CA (US)

( * ) Notice: Subject to any disclaimer, the term of this patent is extended or adjusted under 35 U.S.C. 154(b) by 0 days.

(21) Appl. No.: 17/202,603

(22) Filed: Mar. 16, 2021

(65) Prior Publication Data

US 2022/0304123 A1 Sep. 22, 2022

(51) Int. Cl.
*H05B 45/345* (2020.01)
*F21V 23/00* (2015.01)
*F21Y 115/10* (2016.01)

(52) U.S. Cl.
CPC ..... *H05B 45/345* (2020.01); *F21V 23/005* (2013.01); *F21Y 2115/10* (2016.08)

(58) Field of Classification Search
CPC ..... H05B 45/345; F21Y 2115/10
See application file for complete search history.

(56) References Cited

U.S. PATENT DOCUMENTS 5,631,815 A * 5/1997 Cross ..... H02M 7/10 315/411
9,419,538 B2 * 8/2016 Furmanczyk ..... H02M 7/068
10,631,386 B1 * 4/2020 McRae ..... H05B 45/37

* cited by examiner

*Primary Examiner* — Anh Q Tran
(74) *Attorney, Agent, or Firm* — Orbit IP, LLP

(57) ABSTRACT

LED systems with a multi-channel direct current power supply unit. The system has a first circuit in electrical communication with a first channel of the power supply and a second circuit in electrical communication with a second channel of the power supply. The power supply provides a constant current to the first and second circuits. The system has a third circuit in electrical communication with the ground of the power supply. A plurality of driverless luminaires are connected in series wherein each driverless luminaire has a first LED array electrically connected in series to the first circuit and a second LED array electrically connected in series to the second circuit and a driverless luminaire ground electrically connected to the third circuit.

20 Claims, 7 Drawing Sheets

LIGHTING SYSTEMS

FIELD

The present invention generally relates to lighting systems and methods of using the same. In particular, the present invention relates to lighting systems that allow multiple LED's to be electrically connected in series and illuminated without the need for individual drivers for each LED array. These lighting systems are designed specifically to be cost effective solutions for the illumination of greenhouses, although they may be used for any purpose.

BACKGROUND

Conventional LED fixtures comprises three major parts:

(a) LED diodes (when mounted on metal clad boards they are often referred to as light modules or light engines);

(b) At least one driver (provides for AC-to-DC conversion, filtering, transient protection, constant current power supply; and (c) Housing (primarily used as a heat sink).

The fixture can also include secondary optics or lenses.

While LED prices are decreasing, and performance is increasing, the driver and housing costs have remained fairly constant.

Large commercial installations may utilize hundreds or thousands of LED fixtures, each including its own expensive AC-DC driver circuit.

Typically, in the United States, power from the power mains is specified at 480V, 60 Hz AC, Triple phase. As noted above, power needs to be supplied to individual fixtures of LED lights. The desired LEDs require 20V DC at 7.5 A and power to be current regulated and maintained steady at 7.5 A.

FIG. 2A illustrates a current system for accomplishing the illumination of a large number of LEDs. As may be seen in FIG. 2A, each fixture of LEDs utilizes individual drivers that are connected to the main power line. Power electronics are required to convert AC to DC, step down the voltage and regulate the current to the LEDs. This configuration requires expensive electronics for each fixture and expensive power line wiring to each fixture.

FIG. 2B illustrates another current system for accomplishing the illumination of a large number of LEDs. As may be seen in FIG. 2B, a centralized AC-DC system with a step-down power source is utilized. A number of fixtures are connected in parallel (for example 20 fixtures) and power is supplied using a large AC-DC power source that delivers 20V at 150 amps. However, 150 amps at 20 VDC requires large gauge wires (especially over the long distances in a greenhouse installation), which can significantly increase costs and suffer from major line losses, reducing efficiency. Moreover, the large AC-DC power source is expensive and, in the end, may not deliver much savings over the current method noted above. In addition, some electronics are still required in each fixture to provide current regulation.

U.S. Pat. No. 10,595,387 issued to the current inventor and titled "Driverless LED Fixture" (hereinafter "'387 Patent") teaches the use of a direct current power supply to power a plurality of LEDs in series. See FIG. 2C. However, the '387 Patent only provides for a single circuit and single LED arrays and therefore, does not take advantage of the efficiencies of multi-circuit power supply.

SUMMARY OF THE EMBODIMENTS

Objects of the present patent document are to provide improved lighting systems that are cheaper to manufacture and cheaper to install than current systems. In preferred embodiments, the lighting systems ameliorate many of the deficiencies in the costs of making and installing current systems. In particular, the embodiments herein are designed to provide the cheapest possible LED lighting solutions for lighting large growing operation such as those found in greenhouses.

In preferred embodiments, the LED system comprises a direct current power supply unit having a first channel and a second channel and a ground; a first circuit in electrical communication with the first channel of the power supply wherein the power supply provides a constant current to the first circuit; a second circuit in electrical communication with the second channel of the power supply wherein the power supply provides a constant current to the second circuit; a third circuit in electrical communication with the ground of the power supply; and a plurality of driverless luminaires connected in series wherein each driverless luminaire in the plurality of driverless luminaires has a first LED array electrically connected in series to the first circuit and a second LED array electrically connected in series to the second circuit and a driverless luminaire ground electrically connected to the third circuit.

In some embodiments, the first channel is comprised of a first three constant current drivers with outputs electrically connected in parallel and the second channel is comprised of a second three constant current drivers with outputs electrically connected in parallel.

In yet other embodiments, generally those embodiments used with three-phase AC power, the power inputs to the first three constant current drivers are electrically connected in a delta configuration and wherein the power inputs to the second three constant current drivers are connected in a delta configuration.

In still other embodiments, generally those with single phase AC power inputs, the power inputs to the first three constant current drivers are connected in parallel and wherein the power inputs to the second three constant current drivers are connected in parallel.

In preferred embodiments, the power supply is configured to adjust a first current on the first channel with respect to a second current on the second channel in response to an input signal. The input signal can be a pair of voltage signals communicated to an input of each of the first three constant current drivers and each of the second three constant current drivers.

In some embodiments, the power supply is configured to supply between 6 kilowatts and 20 kilowatts. In the preferred embodiment, the power supply is configured to supply 10 kilowatts, which is comprised by two 5 kilowatt channels and each channel is made up of three 1650-watt drivers.

In preferred embodiments, a first LED array anode is electrically connected directly to a first channel anode of the power supply and a second LED array anode is electrically connected directly to a second channel anode of the power supply and there is no driver between the first LED array and the first channel anode and there is no driver between the second LED array and the second channel anode.

In further embodiments, a first LED array cathode is electrically connected directly to a next driverless luminaire's first LED array anode and a second LED array cathode is electrically connected directly to a next driverless luminaire's second LED array anode and there is no driver between the first LED array and the next driverless luminaire's first LED array and there is no driver between the second LED array and the next driverless luminaire's second LED array.

DETAILED DESCRIPTION OF THE PREFERRED EMBODIMENTS

Figure 1:
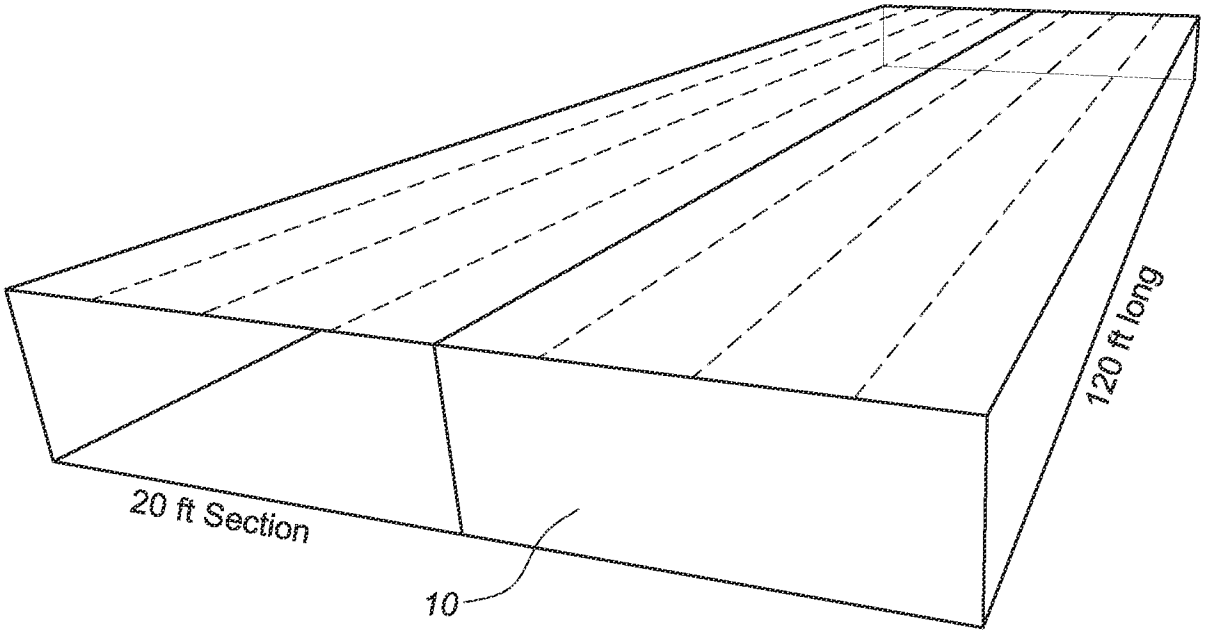
FIG. 1 PRIOR ART
FIG. 1 is a simplified perspective view of a typical greenhouse in which the power distribution system of the present invention can be utilized.

FIG. 1 is a simplified perspective view of a typical greenhouse 10 in which the power distribution system of the present invention can be utilized. Greenhouses, especially when located in the middle and high latitudes, require supplemental artificial lighting in order to grow crops, such as tomatoes, year-round.

The dimensions of a typical section of a greenhouse configuration may be as follows: Length: Typically, between 100 and 120 feet; Width: 20 feet per section width; LED lights: 11,12,13 Multiple rows (3 shown) approximately 4 feet apart in length.

Since lights (fixtures) are typically hung every 4 feet, there are from 25 to 30 light fixtures per row. The Applicant has realized that the size and lighting requirements for many greenhouses have been standardized or are, at a minimum, very often similar. To this end, there is a real opportunity in the market to develop the cheapest possible lighting solution that can illuminate such a space.

Figure 2A:
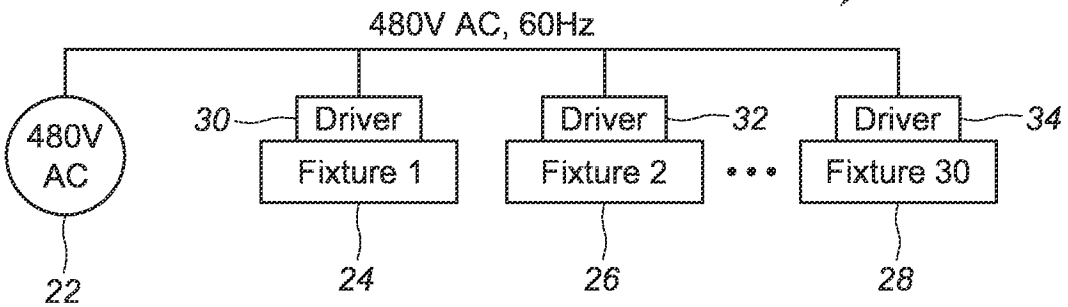
FIG. 2A PRIOR ART
FIG. 2A is a simplified block diagram of a prior art power distribution system that could be used in for the greenhouse shown in FIG. 1.

FIG. 2A is a block diagram of a current method for providing power to a power distribution system 20. System 20 is powered by a source 22 of 480 volts, 60 Hz AC which is coupled to a series of fixtures 24 and 26 and the last fixture 28 in a row via driver circuits 30, 32 and 34, respectively.

Figure 2B:
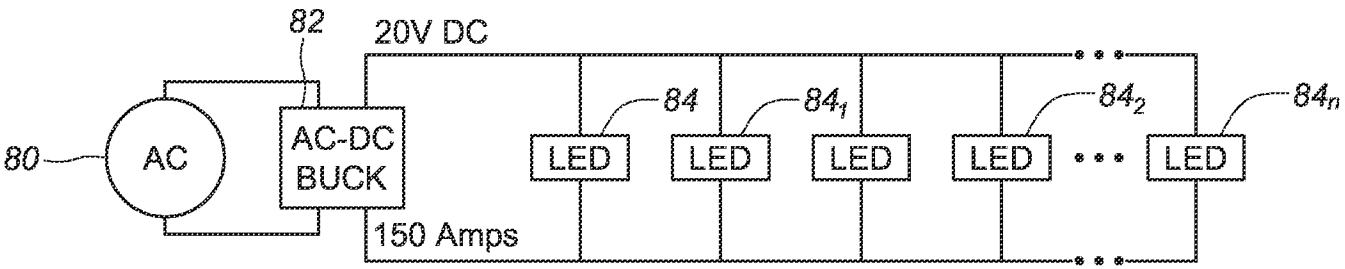
FIG. 2B PRIOR ART
FIG. 2B is a simplified block diagram of a possible power distribution system that could be utilized in the greenhouse of FIG. 1.

FIG. 2B is a block diagram of a power distribution system that may be used in place of the system shown in FIG. 2A. A source of AC power 80 is coupled to step-down device 82 which provides 20 VDC and 150 amps to a series of LED fixtures 84, 84, 84, . . . 84*n*.

Figure 3:
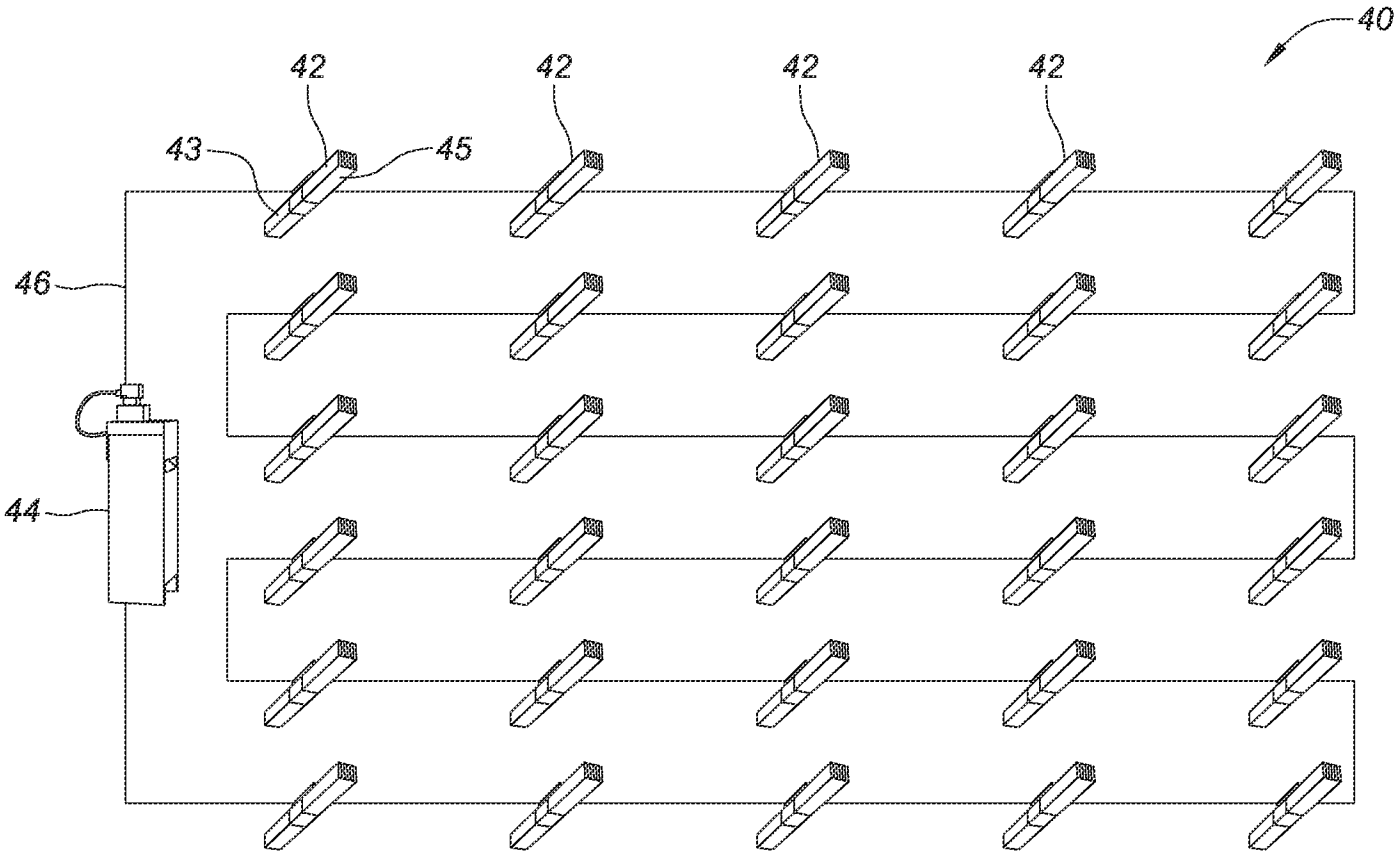
FIG. 3 illustrates a schematic view of an LED system according to the teachings herein that could be utilized in the greenhouse of FIG. 1.

FIG. 3 illustrates a schematic view of an LED system 40 according to the teachings herein. The LED system 40 comprises a power supply unit 44 and a plurality of driverless luminaires 42. In preferred embodiments, the power supply unit 44 is a direct current power supply unit.

The LED system 40 includes a plurality of driverless luminaires 42. In preferred embodiments, each driverless luminaire comprises a housing and at least two LED arrays; a first LED array 43 and a second LED array 45. In other embodiments, driverless luminaires 42 may be comprised of three, four, five or more LED arrays.

As noted above, a typical luminaire consists of three parts, LED board (or light engine), heat sink or physical enclosure and the driver. The embodiments herein consist exclusively of driverless luminaires that only include the LED board and the heat sink/housing and do not include a driver. A driverless luminaire is one or more LED board(s) (which consist of LED diodes mounted on PCBs) which thermally interface with a heat sink or enclosure. Separate luminaires will necessarily have physically separate heat sinks or enclosures that act as heat sinks.

An LED array is a group of LEDs connected in a series-parallel fashion. Each array consists of nS×mP LED diodes, where n represents the number of LEDs connected in series and m represents the number of LEDs in parallel. More than one array can exist on one PCB and one array can sometimes be mounted on multiple PCBs so the relationship of LED array to PCB is not necessarily one-to-one. For example, in some embodiments, the red channel LEDs are in a 8S×10P array and the white channel LEDs are connected in a 3S×26P array fashion. The driverless luminaire may consist of two PCBs and one heat sink. Each PCB contains 50% of the red LEDs and 50% of the white LEDs.

Each LED array 43, 45, is comprised of a plurality of LEDs, typically from 1 to 300 but may be up to 1000 or more. As explained above, within the LED arrays, the individual LEDs are electrically connected in series-parallel fashion. The number of LEDs connected in series in each array is limited by total voltage available to the array divided by the average voltage drop (forward voltage, $V_f$) of each LED in the array. The number of LEDs in parallel is dictated by the total available current for the array divided by the desired current per LED. Thus, LED arrays can be configured to meet any particular LED driverless luminaire power and efficiency criteria.

The LED system 40 has the plurality of driverless luminaires 42 electrically connected in series. In particular, a single LED array 43, 45, in each driverless luminaire 42 is electrically connected in series with the corresponding LED array 43, 45 in the other driverless luminaires 42. To this end, a first LED array 43, in the first driverless luminaire 42 is electrically connected in series with the first LED array 43 in all the other driverless luminaires 42. In addition, a second LED array 45, in the first driverless luminaire 42 is electrically connected in series with the second LED array 45 in all the other driverless luminaires 42.

In preferred embodiments, three phase AC power is applied to the power supply unit 44. The AC power may be at any voltage but in typical installations it will be around 480V. While most embodiments will be supplied three phase AC power, because that is often how power is distributed, embodiments may be powered with single phase AC power as explained in more detail below.

In preferred embodiments, the supplied power goes through an EMI filter and then through a bridge rectifier to the main switch. A transformer provides galvanic isolation. Power from the transformer is then rectified to DC via and regulated through a feedback loop consisting of a reference or error amplifier, an optocoupler and a driver signal generator. The power output of the power supply unit 44 is constant current DC.

Figure 4:
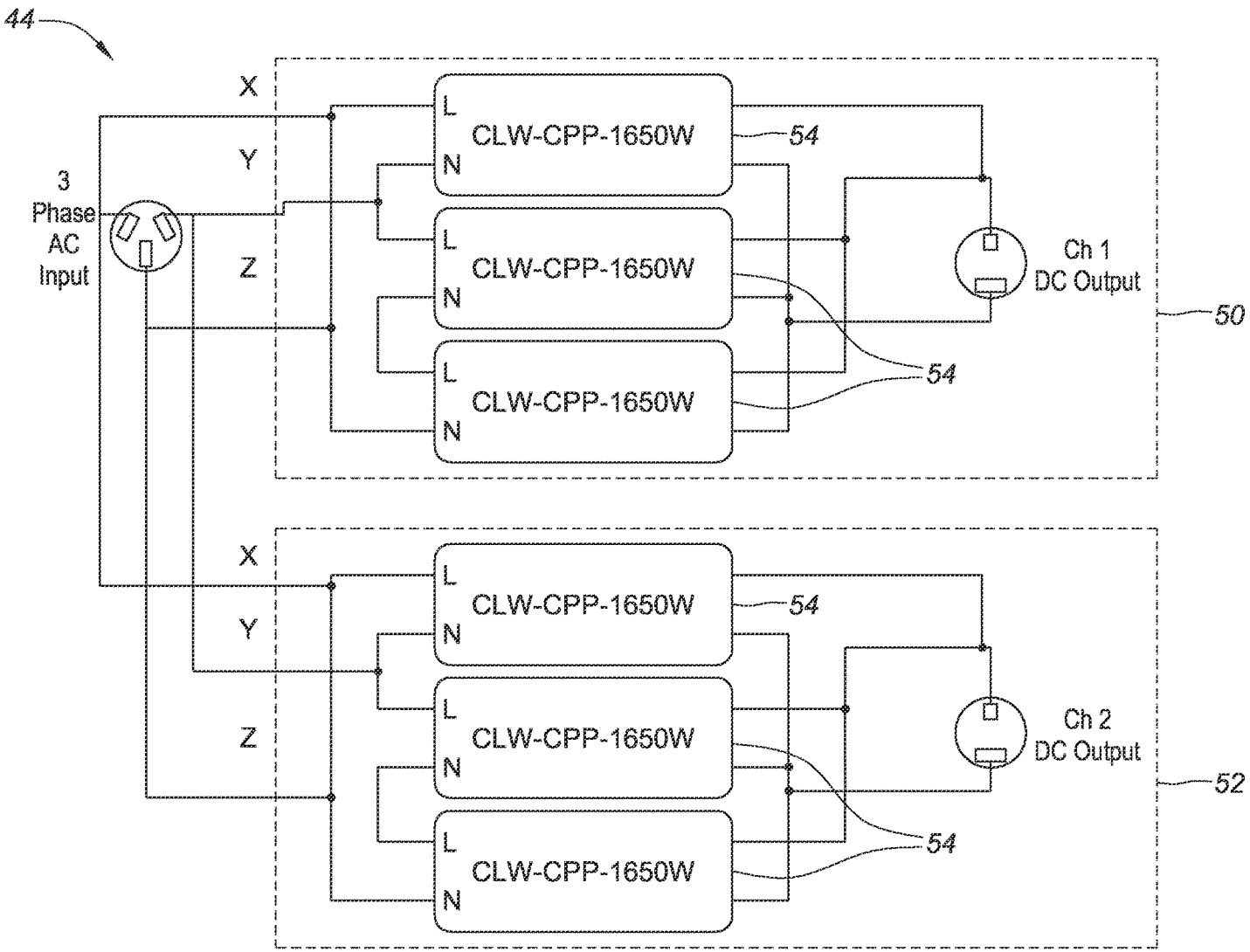
FIG. 4 shows one embodiment of a power unit 44 that receives 3-phase AC power and is for use with LED light systems taught herein.

FIG. 4 shows one embodiment of a power unit 44 that receives three-phase AC power and is for use with LED light systems. The power unit 44 has multiple channels. In the embodiment shown in FIG. 4, the power unit 44 has two channels, a first channel 50 and a second channel 52. However, other embodiments may have more than two channels and in particular may have three, four or five channels. In yet other embodiments, the power unit 44 may have even more than five channels.

As used herein, a "channel" means a current or voltage regulated DC power output with separate cathode and anode terminals. Multiple channels can come from one driver or separate drivers. Separate channels are typically connected to different LED arrays, often with different color LEDs. The channels are controlled independently so their voltage and current levels can be modulated to vary the light intensity of each color LED array, thus varying the total light output spectrum of the luminaire.

When the power supply 44 is multi-channel, each channel may be comprised of a number of individual drivers 54. In the embodiment shown in FIG. 4, each channel is comprised of three smaller drivers 54. In the embodiment shown in FIG. 4, the first channel 50 is designed to output 5 kilowatts and is comprised of three 1650-Watt constant current drivers electrically connected in parallel. The second channel 52 is an identical setup. As used herein, the term "driver" means any device that receives the input power and conditions it and outputs either a constant current or constant voltage DC power.

As may be seen in FIG. 4, the input to the power supply 44 is three phase AC power. In preferred embodiments that use three phase AC power as the input, the power inputs to the constant current drivers may be electrically connected in a delta configuration. In the embodiment shown in FIG. 4, the power inputs to the first three constant current drivers are electrically connected in a delta configuration and the power inputs to the second three constant current drivers are electrically connected in a delta configuration.

The Delta or Mesh electrical configuration (A) is also known as three phase three wire system (3-Phase 3 Wire). In a Delta (also denoted by A) configuration, the starting ends of the three phases or coils are connected to the finishing ends of the coil. Or the starting end of the first coil is connected to the finishing end of the second coil and so on (for all three coils) and it looks like a closed mesh or circuit. In other words, all three coils are connected in series to form a close mesh or circuit. Three wires are taken out from three junctions and all outgoing currents from the junction are assumed to be positive.

In the embodiment shown in FIG. 4, the outputs of the first three constant current drivers 54 are electrically connected in parallel and the outputs 54 of the second three constant current drivers are electrically connected in parallel.

Figure 5:
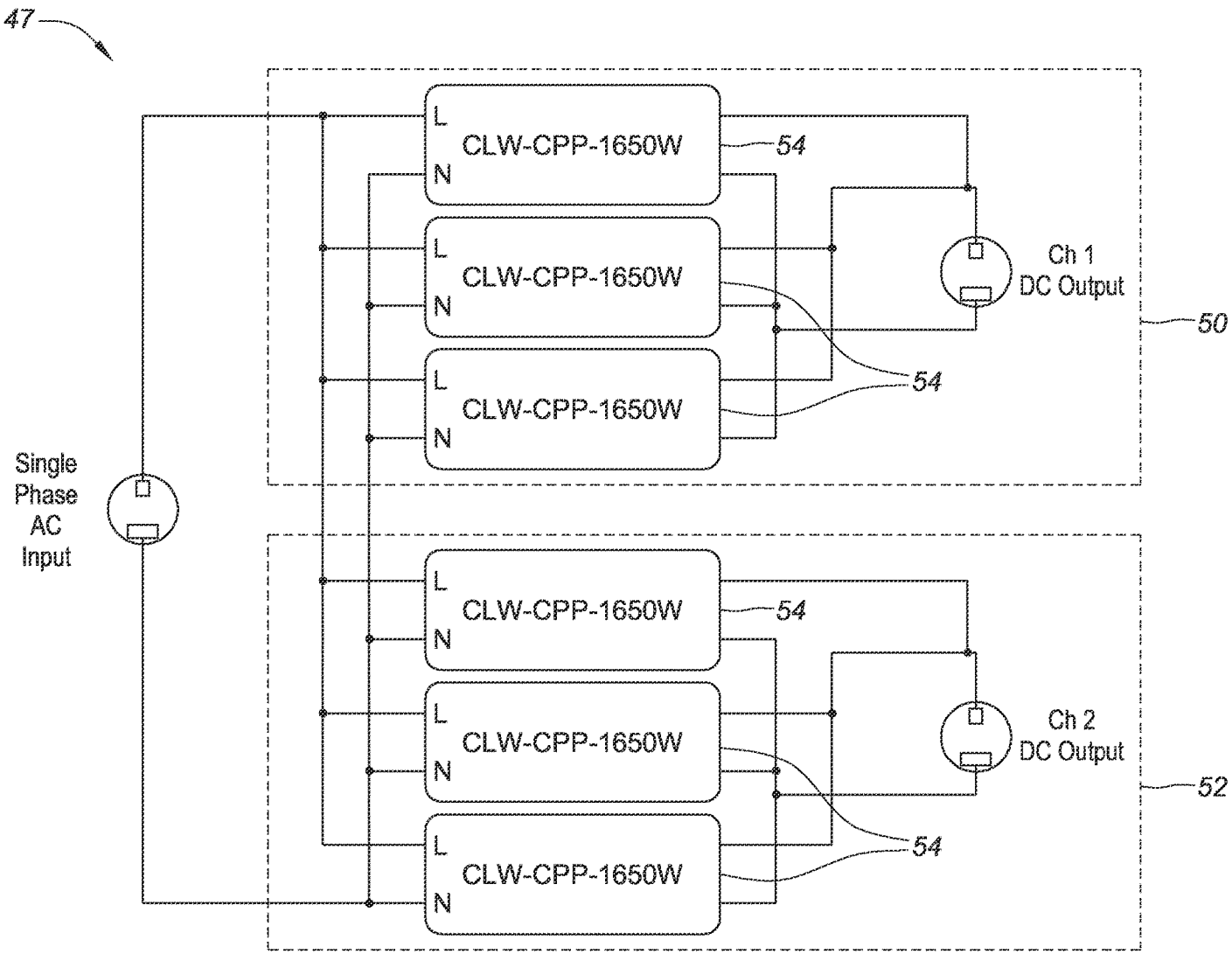
FIG. 5 shows one embodiment of a power unit 47 that receives single phase AC power and is for use with LED light systems taught herein.

FIG. 5 shows one embodiment of a power unit 47 that receives single phase AC power and is for use with LED light systems. The embodiment in FIG. 5 is similar to that in FIG. 4 in that it has two channels 50 and 52 and each channel is comprised by three drivers 54. However, unlike the embodiment in FIG. 4, which is designed for three phase power, the embodiment in FIG. 5 is designed to accept single phase AC power. To this end, rather than using a delta configuration for the inputs to the drivers, the embodiment in FIG. 5 electrically connects the power inputs to each of the drivers 54 in parallel. As may be seen in FIG. 5, the power inputs to the first three constant current drivers 54 are connected in parallel and the power inputs to the second three constant current drivers 54 are connected in parallel.

The power supply 44 or 47 may generally run on any input voltage but typically voltages may be 120, 208, 240, 347, 400 or 480V.

As may be appreciated, the outputs in FIG. 5 are connected the same way as the outputs in FIG. 4. The outputs of the first three constant current drivers 54 are electrically connected in parallel and the outputs 54 of the second three constant current drivers are electrically connected in parallel.

In general, to keep electrical installations safe, they should be limited to a maximum voltage of 500V DC on all external electrical wires and cables. Cables/wiring rated to a maximum of 600V are relatively inexpensive and not very bulky. Going to higher voltages increases cable cost as well as risk of shock and fire. It's difficult to design efficient LED arrays below 10V. Since $V_f$ of blue or white LEDs is around 3.2V, that's only 3 LEDs in series. $V_f$ varies slightly from LED to LED due to die manufacturing process variation. Therefore, in order to keep the parallel strings of the LED array as even as possible, it's desirable to have a minimum of 3 LEDs in series=10V per array. This means 500V/10V=50 luminaires max per channel.

Maximum current per channel is dictated by the gauge of cable that's relatively inexpensive and readily available. Keeping the wire gauge above 14 AWG is desirable to save costs. That limits max current to about 10 amps, especially for long cables. Thus, the maximum power per array is 10V×10 A=100 W. In order to increase the power of each luminaire and still meet all the criteria above, more channels per luminaire may be used. Accordingly, with a three-wire cable interconnect, two channels and 200 W per luminaire can be achieved. Three channels on a four-wire cable would provide 300 W per luminaire. In some embodiments, the voltage per array could be increased to 20V and the power increased per channel to 200 W but that reduces the number of luminaries per 10 KW driver to (500/20)=25. For maximum coverage of a 100 ft. greenhouse, it is desirable not to reduce the number of driverless luminaires per driver below 25 in order to cover the entire row of the 100-foot greenhouse with one driver on one end. Accordingly, the best way to increase the power to the desired 400 W per luminaire while still meeting all the other voltage/current requirements above is to add an additional channel.

Luminaires may be electrically connected in series or parallel. In the embodiments herein they are electrically connected in series because it's easier to connect them in a chain/row, smaller gauge wires may be used due to higher voltage, and a lower current is required. The embodiments herein don't use parallel connections because it makes it difficult to connect a large number of luminaires fixtures in a row. In addition, parallel connections would require a high current, which in turn requires large and expensive gauge wires.

In some embodiments, a single 5-Kilowatt driver could be used. However, in preferred embodiments, the power supply includes two, three, four, five or six drivers. Using multiple smaller watt drivers is easier and cheaper than a massive single driver. In preferred embodiments, three 1650 W drivers are used.

The most efficient way to run three single phase AC drivers with three phase power is to connect them in delta fashion. This keeps the voltage high per driver and the current low. Drivers typically run more efficiently at higher voltages and the wiring for lower current is smaller and less expensive. Accordingly, the embodiments herein may use three smaller drivers paralleled at the output. This creates a power supply that is easier to design, less expensive to build (than one large driver) and allows the inputs to be connected directly to three phase power.

Figure 6:
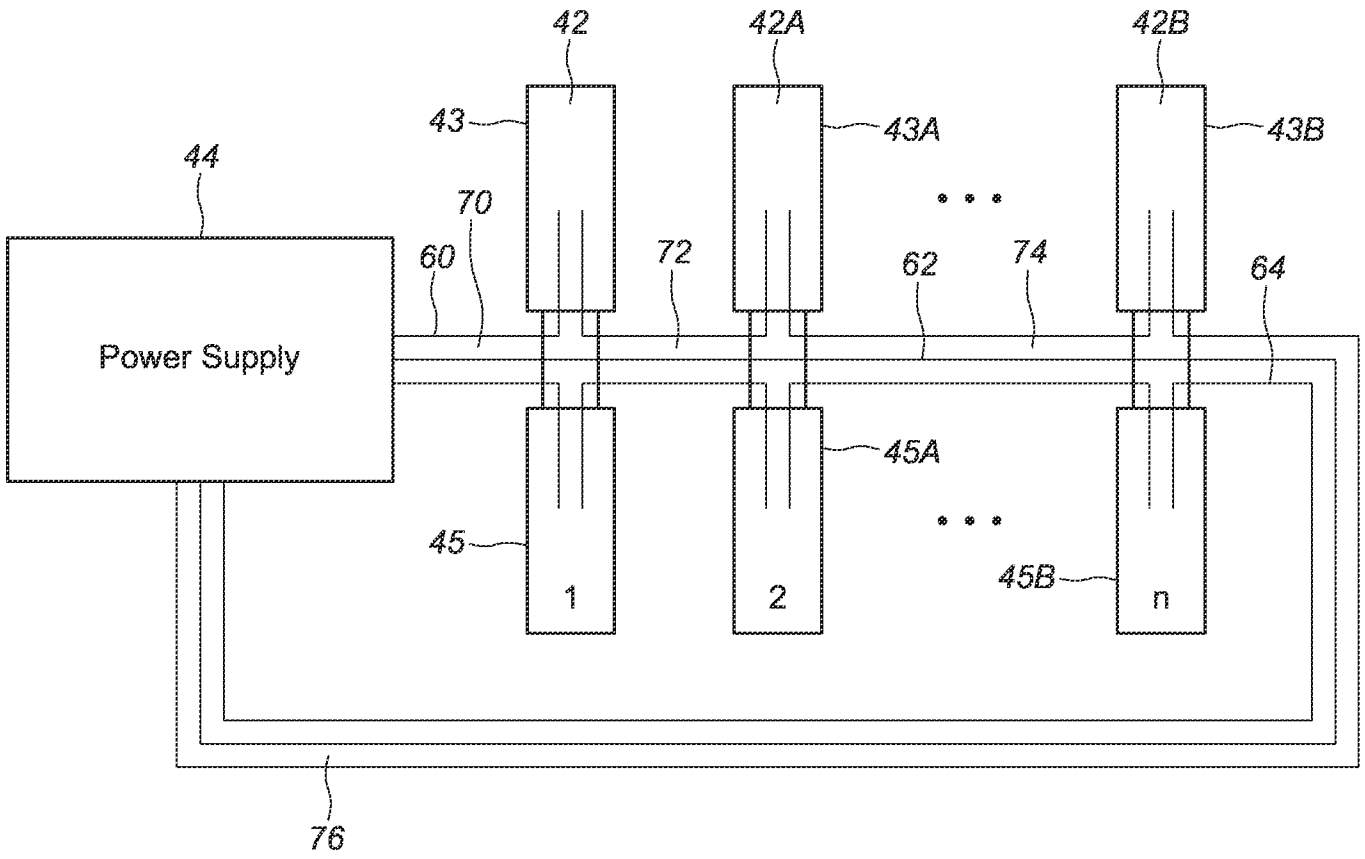
FIG. 6 illustrates a schematic view of a plurality of luminaires electrically connected to a power supply.

FIG. 6 illustrates a schematic view of a plurality of driverless luminaires 42 electrically connected to a power supply 44. In the embodiment in FIG. 6, the cable connecting the driverless luminaires 42 has a first circuit 60, a second circuit 64 and a third circuit 62. The first circuit 60 is in electrical communication with the first channel of the power supply 44. The power supply 44 provides a constant current to the first circuit 60. The second circuit 64 is in electrical communication with the second channel of the power supply 44. The power supply provides a constant current to the second circuit 64.

A third circuit 62 is in electrical communication with the ground of the power supply and the chassis of each driverless luminaire 42 in the plurality of driverless luminaires.

Each driverless luminaire 42 in the plurality of driverless luminaires is connected in series such that each driverless luminaire in the plurality of luminaires has a first LED array 43 electrically connected in series to the first circuit 60 and a second LED array 45 electrically connected in series to the second circuit 64 and a driverless luminaire ground electrically connected to the third circuit 62.

In a preferred embodiment, the LED system consists of a 10-Kilowatt central power supply unit 44 connected to up to 30 LED driverless luminaires 42 in series fashion. The central power supply unit 44 (referred to as a Central Power Pack or CPP) is designed to be a two channel-, constant current LED driver, with each channel supplying up to 500V DC at 10 amps. The driverless luminaires 42 are connected in series fashion to the CPP 44. In the embodiment shown in FIG. 6, all connections between the CCP 44 and fixtures 42, 42A and 42B is achieved using a three-wire power cable. One wire for each channel plus a ground. As may be appreciated, for systems with more channels, extra wires in the cable may be used, one extra wire for each channel.

The driverless luminaires 42 consist of two sets of the LED arrays, 43 and 45. Each LED array 43 and 45 consists of one or more color LEDs combined to deliver a certain color spectrum. The two LED channels may emit different color spectra such that if the power level to either channel is changed, the emitted spectrum of the LED luminaire changes.

Wire Connections

Assuming N number of driverless luminaires in the LED system, where N is an integer greater than two, the driverless luminaires are electrically connected as follows. A rust three wire cable 70 electrically connects the CPP 44 to the first driverless luminaire 42.

On one end of the cable 70 a first wire 60 connects to the anode (+) terminal for channel one on the CPP 44, a second wire 64 connects to the anode (+) terminal of channel two of the CPP 44 and wire three 62 is connected to the chassis ground.

On the opposite end of this cable 70, the first wire 60 is connected to the anode (+) terminal of the channel one LED array 43 in the first driverless luminaire 42, the second wire 64 is connected to the anode (+) terminal of the channel two LED array 45 of the first driverless luminaire 42 and the third wire 62 is connected to chassis ground of the first driverless luminaire 42.

A second three-wire cable 72 electrically connects the first driverless luminaire 42 to the second luminaire 42A in the following configuration. On one end of the cable 72, a first wire 60 connects to the cathode (−) terminal of the channel one LED array of driverless luminaire 42, a second wire 64 connects to the cathode (−) terminal of the channel one LED array of driverless luminaire 42A and the third wire 62 connects to chassis ground of driverless luminaire 42B.

On the other end of cable 72, the first wire 60 is connected to the Anode (+) terminal of the channel one LED array 43A in driverless luminaire 42A, the second wire 64 is connected to the channel two LED array 45A of the driverless luminaire 42A and the third wire 62 is connected to chassis ground of the driverless luminaire 42A.

An Nth three-wire cable 74 electrically connects driverless luminaire (N−1) 42A to driverless luminaire N 42B in the following fashion. On one end of the cable 74, the first wire 60 connects to the Cathode (−) terminal of the channel one LED array 43A of the N−1 driverless luminaire 42A. A second wire connects to the cathode (−) terminal of the channel 2 LED array 45A of the N−1 driverless luminaire 42A and the third wire connects to chassis ground of the N−1 driverless luminaire 42A. On the other end of this cable 74, the first wire 60 is connected to the Anode (+) terminal of the channel one LED array 43B in the Nth driverless luminaire 42B, a second wire 64 is connected to the channel two LED array 45B of the Nth driverless luminaire 42B and the third wire is connected to chassis ground of the Nth driverless luminaire 42B.

An (N+1)th three-wire cable 76 electrically connects the Nth driverless luminaire 42B back to the CPP 44 in the following fashion. On one end of the cable 76, a first wire 60 connects to the Cathode (−) terminal of the first channel LED array 43B of Nth driverless luminaire 42B. A second wire connects to the cathode (−) terminal of second channel LED array 45B of the Nth driverless luminaire 42B and the third wire 62 connects to chassis ground of Nth driverless luminaire 42B.

On the opposite end of this cable 76, the first wire 60 connects to the Cathode (−) terminal for the first channel on the CPP 44. The second wire 64 connects to the Cathode (−) terminal of the second channel of the CPP 44 and the third wire 62 is connected to the chassis ground.

Dimming and Spectrum Control

Figure 7:
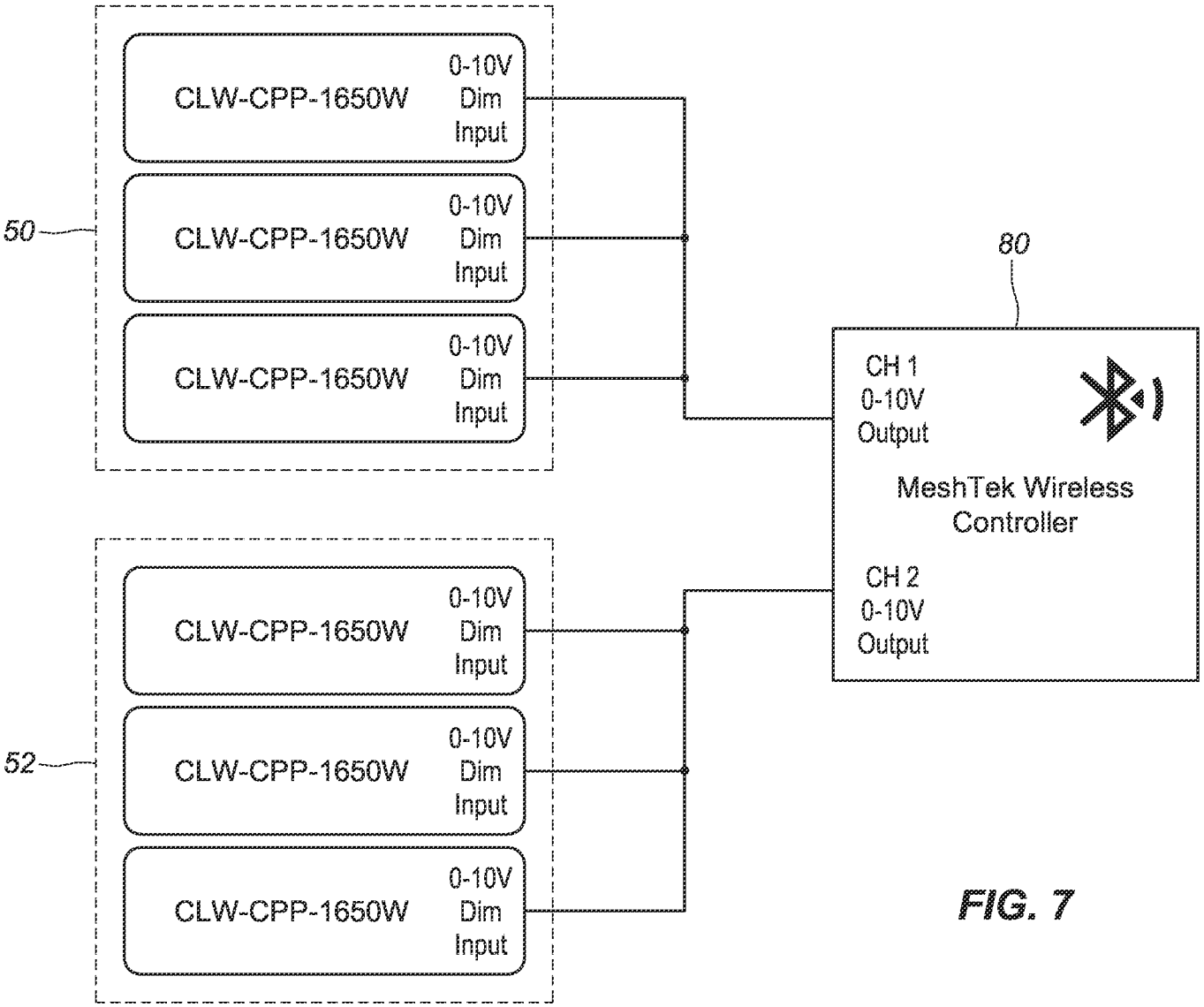
FIG. 7 illustrates a system to achieve spectrum and/or intensity control using a universal 0-10V control interface.

The designs taught herein allow for spectrum control by changing the output light level of each channel independently. FIG. 7 illustrates one method to achieve this spectrum control using a universal 0-10V control interface.

In FIG. 7, the two groups of three drivers in each channel 50 and 52 are controlled with a two-channel 0-10V controller 80. The 0-10V signals can be generated using a wireless device that generates two-separate 0-10V analog signals. Each 0-10V signal is connected to the input of the 3 CLW-CPP-1650 W drivers in parallel fashion as shown in FIG. 7.

In order to dim or change the color of the LEDs, the current can be lowered by a certain amount on either of the two channels. In single spectrum LED's, a change in current will dim the lights. In multi-spectrum LED's a change in current will change the spectrum. Each channel can be changed independently to provide additional adjustments to the intensity and spectrum of the overall LED system.

What is claimed is:

1. An LED system comprising:

a direct current power supply unit having a first channel and a second channel and a chassis ground;

a first circuit in electrical communication with the first channel of the power supply wherein the power supply provides a constant current to the first circuit;

a second circuit in electrical communication with the second channel of the power supply wherein the power supply provides a constant current to the second circuit;

a third circuit in electrical communication with the chassis ground of the power supply;

a plurality of driverless luminaires connected only in series with each other and the direct current power supply unit wherein each driverless luminaire in the plurality of driverless luminaires has a first LED array electrically connected in series to the first circuit and a second LED array electrically connected in series to the second circuit and a driverless luminaire chassis ground electrically connected to the third circuit.

2. The LED system of claim 1, wherein the first channel is comprised of a first three constant current drivers with outputs electrically connected in parallel and the second channel is comprised of a second three constant current drivers with outputs electrically connected in parallel.

3. The LED system of claim 2, wherein power inputs to the first three constant current drivers are electrically connected in a delta configuration and wherein the power inputs to the second three constant current drivers are connected in a delta configuration.

4. The LED system of claim 2, wherein power inputs to the first three constant current drivers are connected in parallel and wherein the power inputs to the second three constant current drivers are connected in parallel.

5. The LED system of claim 2, wherein the power supply is configured to adjust a first current on the first channel with respect to a second current on the second channel in response to an input signal.

6. The LED system of claim 5, wherein the input signal is a pair of voltage signals communicated to an input of each of the first three constant current drivers and each of the second three constant current drivers.

7. The LED system of claim 1, wherein the power supply is configured to supply between 6 kilowatts and 20 kilowatts.

8. The LED system of claim 1, wherein the power supply is configured to supply about 10 kilowatts.

9. The LED system of claim 1, wherein an anode of the first LED array is electrically connected directly to a first channel anode of the power supply and an anode of the second LED array is electrically connected directly to a second channel anode of the power supply and there is no driver between the first LED array and the first channel anode and there is no driver between the second LED array and the second channel anode.

10. The LED system of claim 9, wherein a cathode of the first LED array is electrically connected directly to a next driverless luminaire's first LED array anode and a cathode of the second LED array is electrically connected directly to a next driverless luminaire's second LED array anode and there is no driver between the first LED array and the next driverless luminaire's first LED array and there is no driver between the second LED array and the next driverless luminaire's second LED array.

11. An LED system comprising:

a direct current power supply unit having a first channel and a second channel and a chassis ground;

a first circuit in electrical communication with the first channel of the power supply wherein the power supply provides a constant current to the first circuit;

a second circuit in electrical communication with the second channel of the power supply wherein the power supply provides a constant current to the second circuit;

a third circuit in electrical communication with the chassis ground of the power supply;

a plurality of driverless luminaries connected only in series with each other and the direct current power supply unit wherein each driverless luminaire in the plurality of driverless luminaires has a first LED array electrically connected in series to the first circuit and a second LED array electrically connected in series to the second circuit and a driverless luminaire chassis ground electrically connected to the third circuit and, wherein the first LED array is designed to illuminate directly from the power supplied by the first circuit and the second LED array is designed to illuminate directly from the power supplied by the second circuit.

12. The LED system of claim 11, wherein the first channel is comprised of a first three constant current drivers with outputs electrically connected in parallel and the second channel is comprised of a second three constant current drivers with outputs electrically connected in parallel.

13. The LED system of claim 12, wherein power inputs to the first three constant current drivers are electrically connected in a delta configuration and wherein the power inputs to the second three constant current drivers are connected in a delta configuration.

14. The LED system of claim 12, wherein power inputs to the first three constant current drivers are connected in parallel and wherein the power inputs to the second three constant current drivers are connected in parallel.

15. The LED system of claim 11, wherein the power supply is configured to adjust a first current on the first channel with respect to a second current on the second channel in response to an input signal.

16. An LED system comprising:

a direct current power supply unit having a first channel and a second channel and a chassis ground;

a first circuit in electrical communication with the first channel of the power supply wherein the power supply provides a constant current to the first circuit;

a second circuit in electrical communication with the second channel of the power supply wherein the power supply provides a constant current to the second circuit;

a third circuit in electrical communication with the chassis ground of the power supply;

a plurality of driverless luminaries connected only in series with each other and the direct current power supply unit wherein each driverless luminaire in the plurality of driverless luminaries has a first LED array electrically connected in series to the first circuit and a second LED array electrically connected in series to the second circuit and a driverless luminaire chassis ground electrically connected to the third circuit and, wherein the first LED array is designed to illuminate directly from the power supplied by the first circuit and the second LED array is designed to illuminate directly from the power supplied by the second circuit, and wherein the first channel is comprised of a first three constant current drivers with outputs electrically connected in parallel and the second channel is comprised of a second three constant current drivers with outputs electrically connected in parallel.

17. The LED system of claim 16, wherein power inputs to the first three constant current drivers are electrically connected in a delta configuration and wherein the power inputs to the second three constant current drivers are electrically connected in a delta configuration.

18. The LED system of claim 16, wherein the power supply is configured to adjust a first current on the first channel with respect to a second current on the second channel in response to an input signal.

19. The LED system of claim 16, wherein a first LED array anode is electrically connected directly to a first channel anode of the power supply and a second LED array anode is electrically connected directly to a second channel anode of the power supply and there is no driver between the first LED array and the first channel anode and there is no driver between the second LED array and the second channel anode.

20. The LED system of claim 19, wherein a first LED array cathode is electrically connected directed to a next driverless luminaire's first LED array anode and a second LED array cathode is electrically connected directed to a next driverless luminaire's second LED array anode and there is no driver between the first LED array and the next driverless luminaire's first LED array and there is no driver between the second LED array and the next driverless luminaire's second LED array.

* * * * *